US006342287B1

(12) United States Patent
Kaczmarek et al.

(10) Patent No.: US 6,342,287 B1
(45) Date of Patent: Jan. 29, 2002

(54) ELASTIC PAD, ESPECIALLY UNDER-RAIL

(75) Inventors: Andrzej Kaczmarek, Luboń ; Irena Walkowska, Ujście; Antoni Cala, Wesola; Krystyna Chabolowska, Warszawa; Jan Durski, Warszawa; Jan Jawecki, Warszawa; Andrzej Kamiński, Warszawa; Andrzej Oczykowski, Warszawa, all of (PL)

(73) Assignee: Pandrol Limited, Addlestone (GB)

( * ) Notice: Subject to any disclaimer, the term of this patent is extended or adjusted under 35 U.S.C. 154(b) by 0 days.

(21) Appl. No.: 09/147,988

(22) PCT Filed: Jun. 9, 1997

(86) PCT No.: PCT/PL97/00014

§ 371 Date: Mar. 24, 1999

§ 102(e) Date: Mar. 24, 1999

(87) PCT Pub. No.: WO98/13550

PCT Pub. Date: Apr. 2, 1998

(30) Foreign Application Priority Data

Sep. 27, 1996 (PL) ..... 316320

(51) Int. Cl.[7] ..... B32B 3/00; E01B 9/38

(52) U.S. Cl. ..... 428/156; 428/167; 238/283; 238/382; 248/560; 248/633; 267/141

(58) Field of Search ..... 428/156, 172, 428/167, 180; 5/417; 248/560, 633, 644; 238/283, 382; 267/136, 141, 153

(56) References Cited

U.S. PATENT DOCUMENTS

| | | | | | |
|---|---|---|---|---|---|
| 3,016,317 | A | * | 1/1962 | Brunner | 428/167 |
| 3,423,263 | A | * | 1/1969 | Pannoue | 428/178 |
| 4,104,430 | A | * | 8/1978 | Fenton | 428/175 |
| 4,336,293 | A | * | 6/1982 | Eiden | 428/161 |
| 4,493,471 | A | | 1/1985 | McInnis | 248/580 |
| 4,648,554 | A | | 3/1987 | McQueen | 283/283 |
| 4,822,663 | A | * | 4/1989 | Reott | 428/159 |
| 4,971,247 | A | | 11/1990 | Harkus | 283/283 |
| 5,195,679 | A | | 3/1993 | Leeves et al. | 283/283 |
| 5,335,850 | A | | 8/1994 | Igwemezie | 283/283 |

FOREIGN PATENT DOCUMENTS

| | | |
|---|---|---|
| AU | 2815871 | 11/1972 |
| DE | 865147 | 1/1953 |
| EP | 0169685 | 1/1986 |
| EP | 0279094 | 8/1988 |
| FR | 1211567 | 10/1959 |
| GB | 946936 | 1/1964 |

* cited by examiner

*Primary Examiner*—Donald J. Loney
(74) *Attorney, Agent, or Firm*—Norbert P. Holler

(57) ABSTRACT

An elastic under-rail pad, made of an elastic plastic or rubber, has two opposite sides. At least one of its opposite sides presents a surface which at least partly is defined at least approximately by a simple sinusoidal or cosinusoidal trigonometric function or by a composite sinusoidal and cosinusoidal trigonometric function, so that at least on a part of one of the two opposite sides of the elastic pad there are formed protrusions (3) and cavities (4) arranged alternately and changing softly into one another. The elastic pad is used mainly in permanent ways of rail transport as an element attenuating vibrations and absorbing dynamic loads transmitted by railway vehicles to underlying rails.

4 Claims, 6 Drawing Sheets

ELASTIC PAD, ESPECIALLY UNDER-RAIL

The invention relates to an elastic pad, especially under-rail. made from elastic plastic or rubber, being used mainly in permanent ways of rail transport as an element attenuating vibrations and absorbing dynamic loads transmitted by vehicles to rails.

BACKGROUND OF THE INVENTION

There are known many design solutions of elastic under-rail pads of a general rectangular flat shape, made from plastic or rubber, used in rail transport permanent ways as an element attenuating vibrations and absorbing dynamic loads. Every plastic under-rail pad has two opposite sides, one of them designed to overlie the upper face of a rail foundation member or the upper face of a metal bearing plate and the other side designed to underlie the lower face of a rail foot or the lower face of a metal washer. One or two opposite sides of the pads are provided with different profiles such as grooves, posts and other projections to improve dynamic properties of the elastic under-rail pads and to reduce dynamic surpluses transmitted to a rail foundation.

There is known from German patent specification No. 865147 an elastic under-rail pad consisting of a thin middle plate and regularly spaced on the plate opposite projections projecting at both sides of this thin middle plate, the projections having circular or the like cross-section.

There is known from French patent specification No. 1211567 an elastic under-rail pad having at its two main sides many cylindrical projections or projections in the form of a truncated cone, spaced regularly, on these two sides in such a way that projections at one side are directly opposite projections of the other side of the pad.

There is known from British patent specification No. 946936 an elastic under-rail pad having a number of separate areas bearing load, being in the form of truncated hexagonal projections shaped as a pyramid, which are on both opposite sides of the pad and are separated from one another with grooves of the V letter shape. The hexagonal projections on the opposite sides of the pad are directly opposite one another. In particular embodiments of the pad the projections on one side of the pad are rounded, conical or flat.

There is known from European patent specification No. 169685 an elastic under-rail pad consisting of a membrane made from an elastic material, for example from natural rubber, and of projections of stud-like shape projecting in opposite directions at both main sides of the pad. These stud-like projections having generally cylindrical shape are of the same size and evenly spaced across both sides of the pad.

There is known from U.S. Pat. No. 4648554 and European patent application No. 279094 an elastic under-rail pad comprising many spaced apart circular dimples formed on opposite sides of the pad. Centres of said circular dimples formed on one side of the under-rail pad are offset parallelly in lateral direction relative to the centres of the circular dimples formed on the opposite side of the pad so that the pads form is a network of interlock arch bridge portions when said pad is viewed in cross-section. Each of most circular dimples on one side of the pad lies between four dimples situated on the opposite side of the pad.

There is also known from U.S. Pat. No. 4,971,247 an elastic under-rail pad having projections in the form of separate islands, for example chevron-shaped, on one side or on both opposite sides.

There is also known from U.S. Pat. No. 5,195,679 an elastic under-rail pad having protrusions which are offset on one side of the pad relating to protrusions on the other side of the pad so that when the pad is horizontal no vertical line passes through more than one protrusion. Each protrusion is a separated island and it has its end face of circular or rectangular shape. The protrusions are short cylinders or elongated rectangular prisms.

There is also known from U.S. Pat. No. 5,335,850 an elastic under-rail pad consisting of a central core and many regularly spaced studs projecting at both opposite sides of the core. The studs have two different heights and are offset to one another in such a way that the higher studs on the first side of the pad are opposed by the lower studs on the other side of the pad and the lower studs on the first side of the pad are opposed by the higher studs on the other side. All studs are free standing without interconnection therebetween above said core and have encircling sidewalls of outward convex curvature.

BRIEF SUMMARY OF THE INVENTION

An elastic pad according to the invention, made from elastic plastic or rubber, having two opposite sides is characterized in that at least one of its opposite sides is a surface which at least partly is defined at least approximately by a simple and/or composite trigonometric sinusoidal and/or cosinusoidal function so that at least on a part of one of two opposite sides of the elastic pad there are made protrusions and cavities arranged alternately and changing softly one into another.

It is advantageous if at least on one of opposite sides of the elastic pad at least a part of all protrusions are rolls and at least a part of all cavities are grooves, the rolls and grooves are arranged alternately forming a wavy surface. The rolls and grooves run together side by side along straight lines and/or curves.

It is also advantageous if at least on one of opposite sides of the elastic pad according to the invention, at least a part of all protrusions are cupolas and at least a part of all cavities are bowls while each cupola is surrounded by four adjacent bowls and four adjacent surface fragments of saddle shape, the four bowls and four surface fragments of saddle shape are arranged alternately, also each bowl is surrounded by four adjacent cupolas and four adjacent surface fragments of saddle shape, the four cupolas and four surface fragments of saddle shape are arranged alternately.

The invention ensures to get very effective elastic pads, especially under-rail. During passage of a rail vehicle the elastic pad according to the invention distorts mildly and softly that is why it well attenuates vibrations and absorbs impacts emerging during rolling of rail vehicle wheels on a fragment of the rail lying directly on this pad. The elastic pad, according to the invention, does not shift relating to the lower surface of a rail foot and/or the upper surface of a sleeper, so it does not slip out of the gap between a rail foot and a sleeper, what prevents abrasive wear of the sleeper in its under-rail part and also protects the elastic pad according to the invention, against wearing. During compression of the elastic pad according to the invention, in no its point there is a concentration of stresses and the material of protrusions transfers softly and freely, filling up cavities progressively.

BRIEF DESCRIPTION OF THE DRAWINGS

The invention will now be described by way of examples and with reference to the accompanying drawings in which.

DETAILED DESCRIPTION OF THE INVENTION

Figure 1:
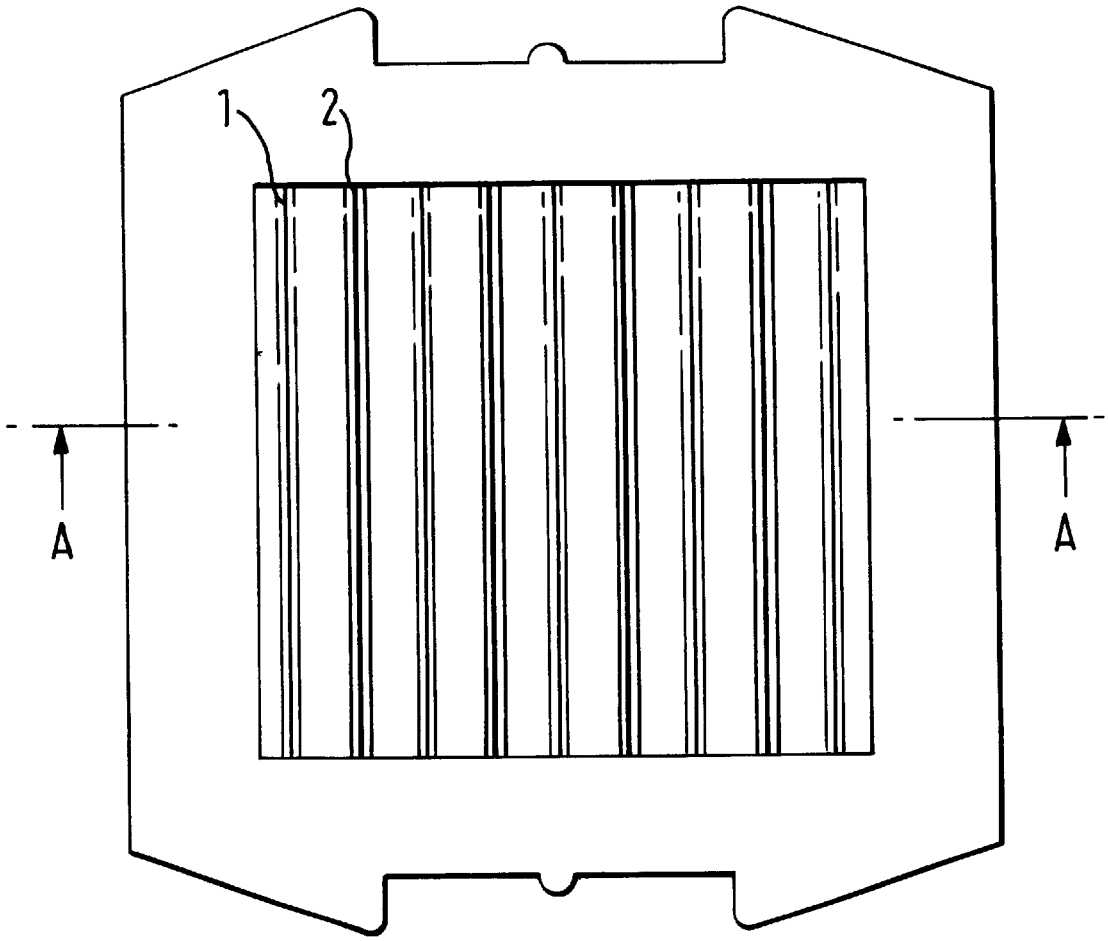
FIG. 1 is a plan view of the first version of embodiment of an elastic under-rail pad according to the invention.
Figure 2:
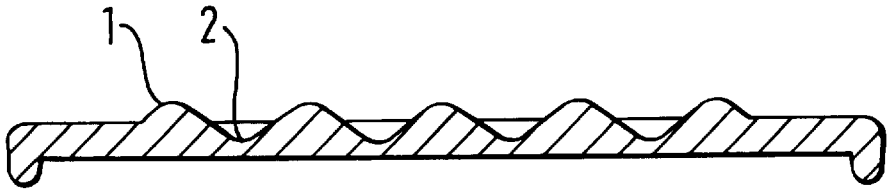
FIG. 2 is a cross-sectional view along the line A—A of FIG. 1 of the same first version of embodiment of the pad.
Figure 3:
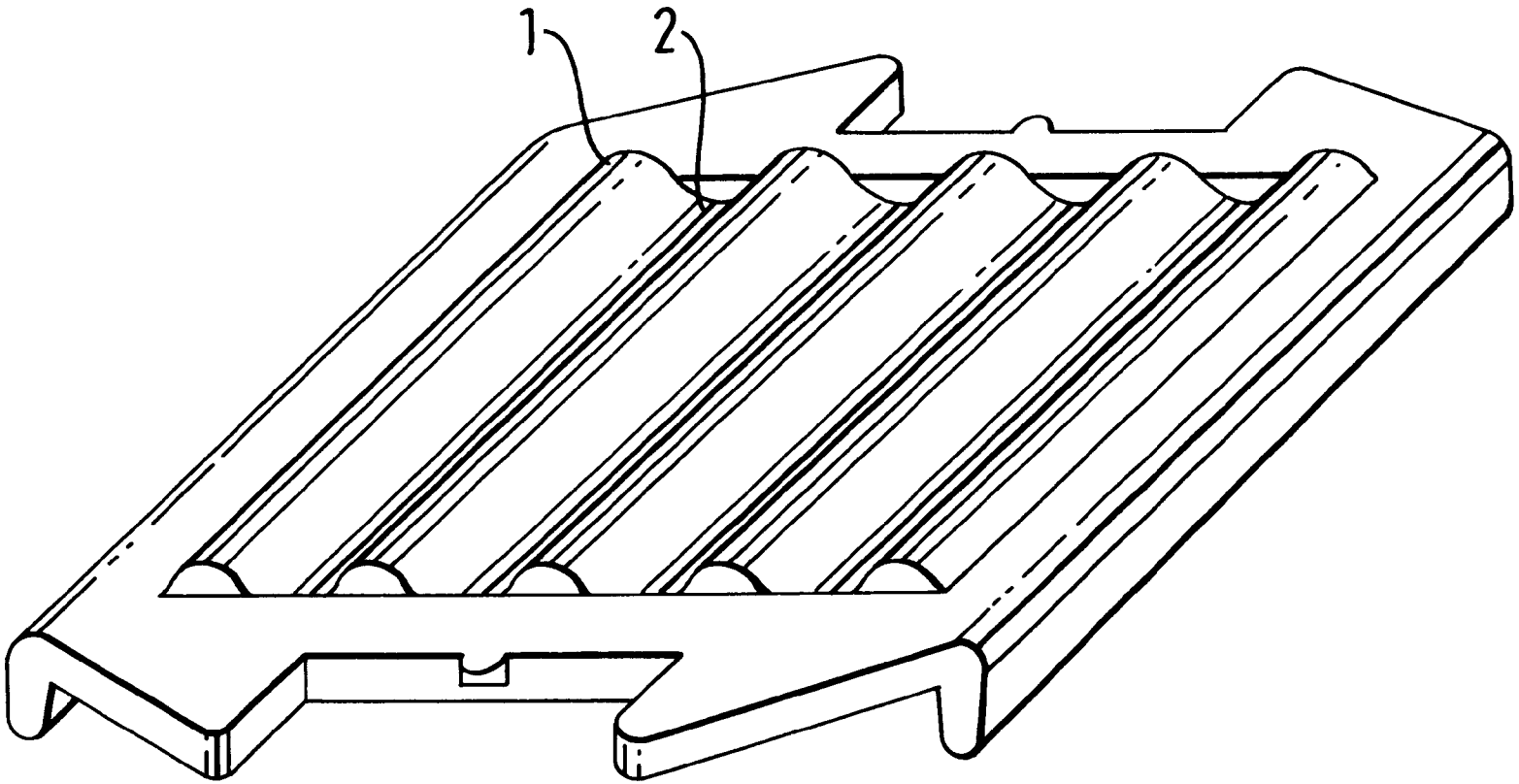
FIG. 3 is an axonometric view also of the first version of embodiment of the pad.
Figure 4:
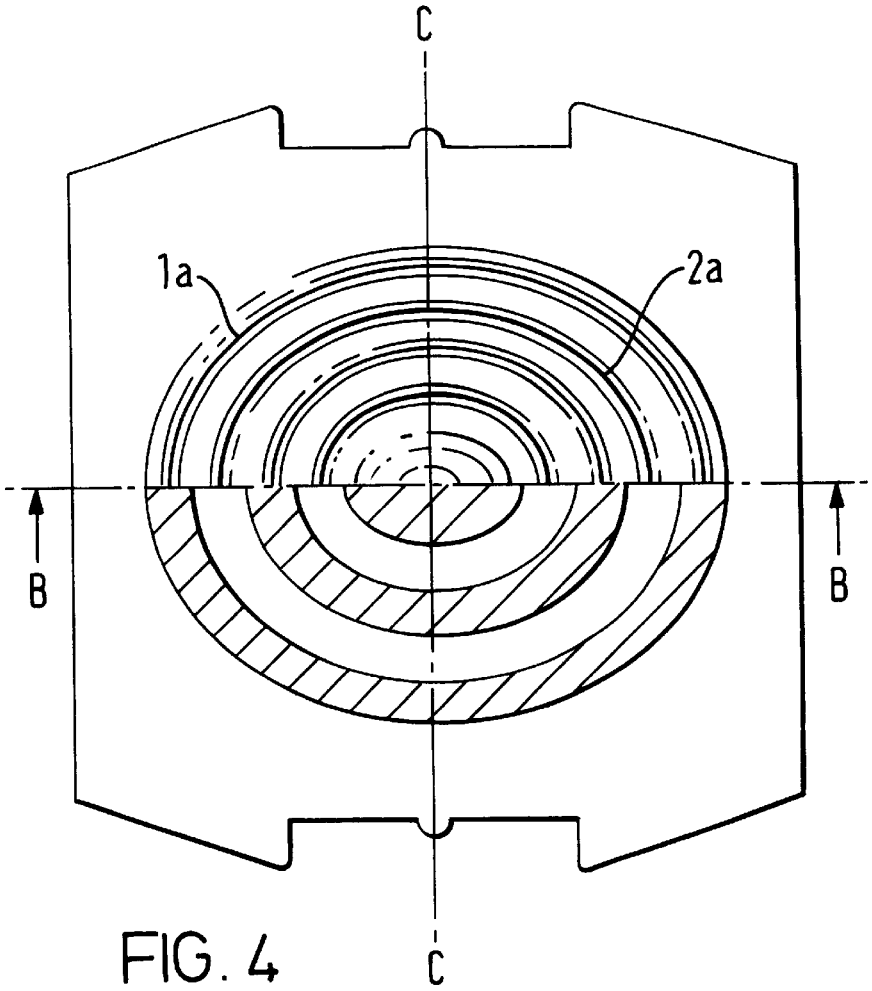
FIG. 4 is partly a plan view and partly cross-sectional view along line D—D of FIG. 5 of the second version of embodiment of an elastic under-rail pad.
Figure 6:
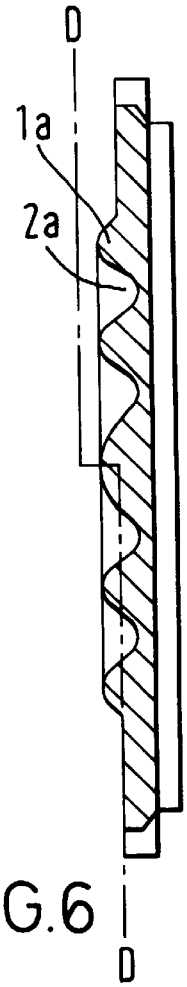
FIG. 6 is a cross-sectional view along the line C—C of FIG. 4 of the same second version of embodiment of the pad.
Figure 5:
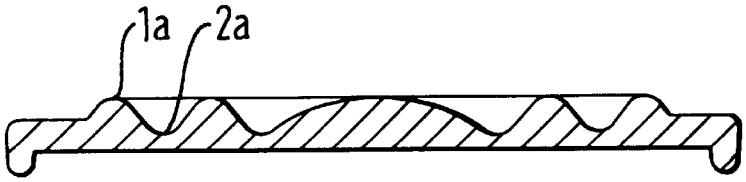
FIG. 5 is a cross-sectional view along the line B—B of FIG. 4 of the same second version of embodiment of the pad.
Figure 7:
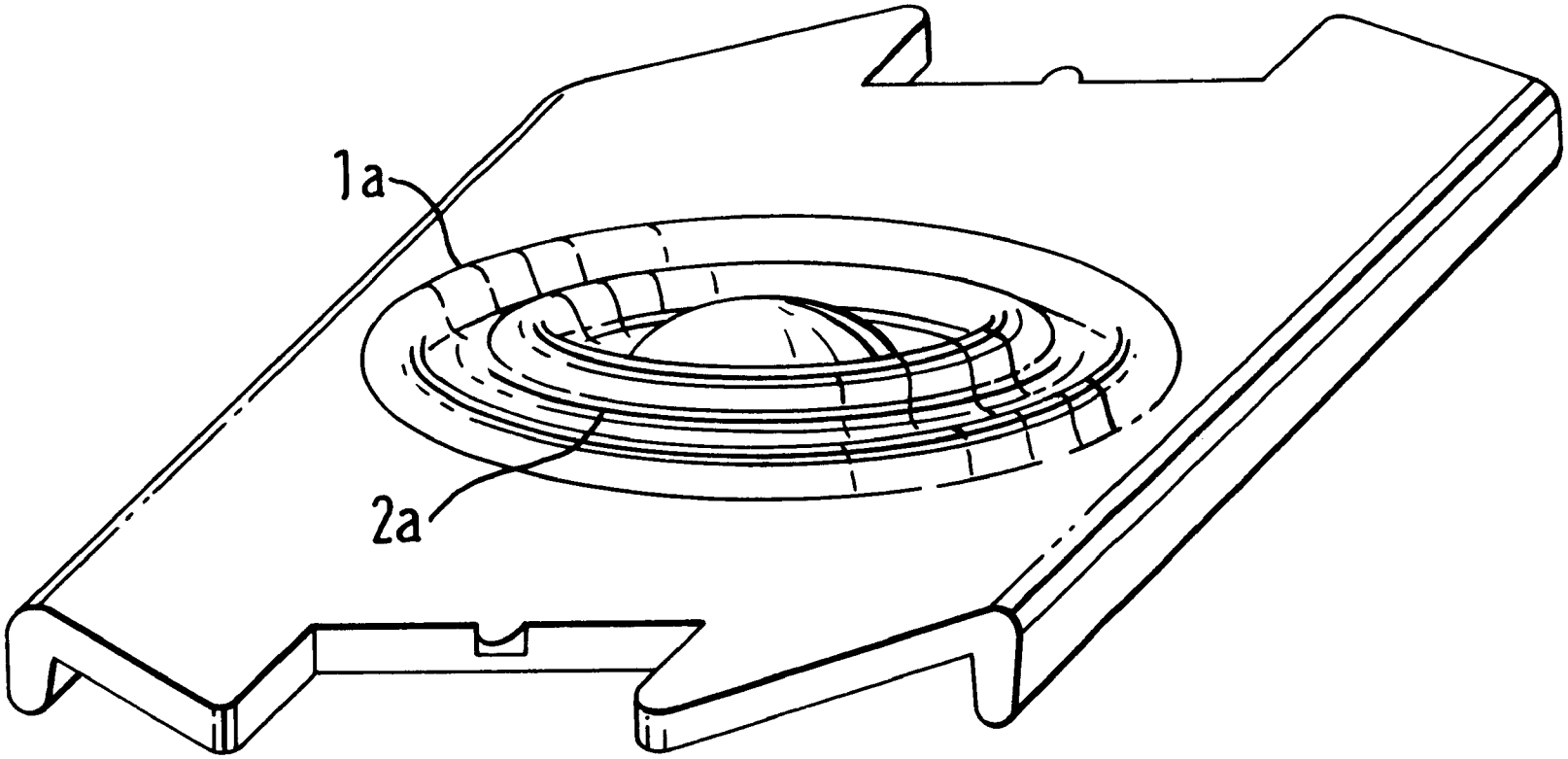
FIG. 7 is an axonometric view also of the second version of the pad.
Figure 8:
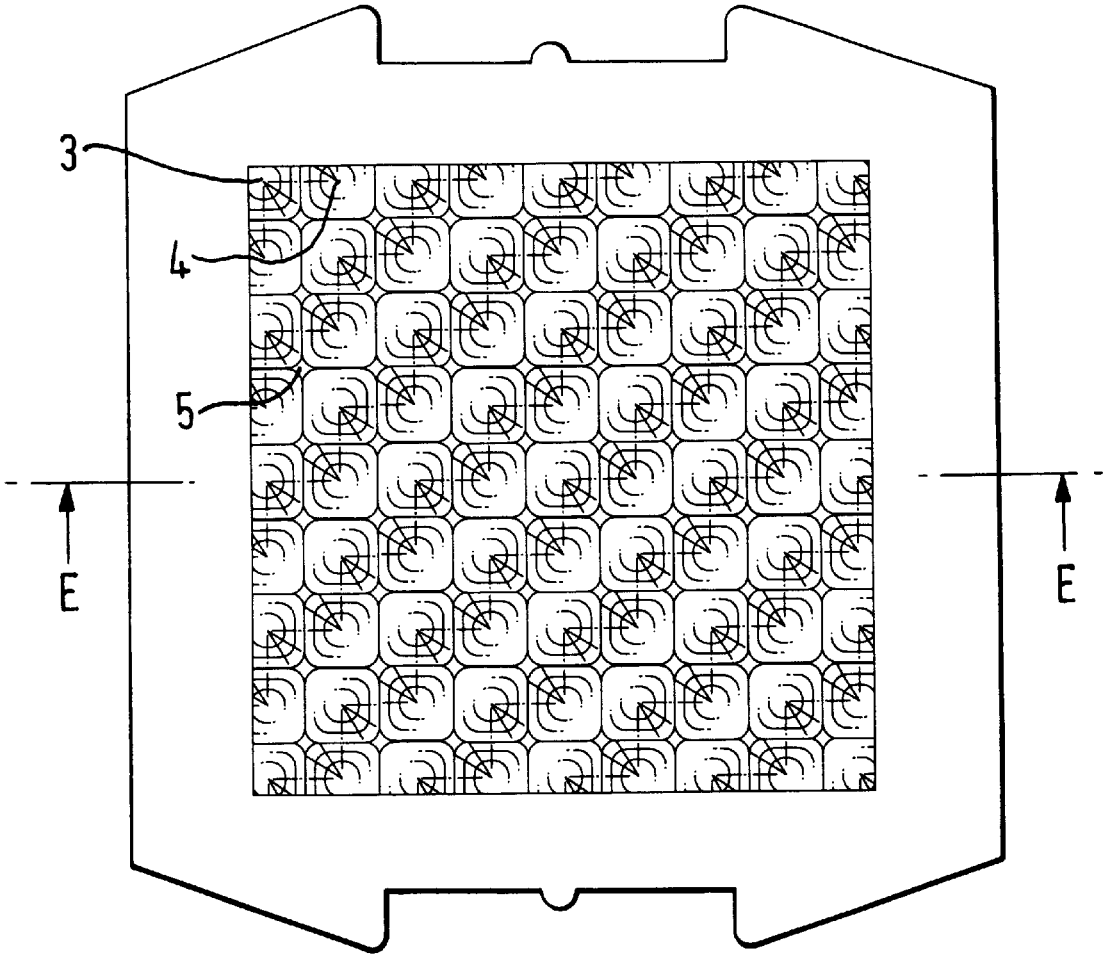
FIG. 8 is a plan view of the third version of embodiment of the elastic under-rail pad according to the invention, the view with use of geodesic lines illustrating the part of upper surface of the elastic pad that is defined by a composite trigonometric sinusoidal function.
Figure 9:
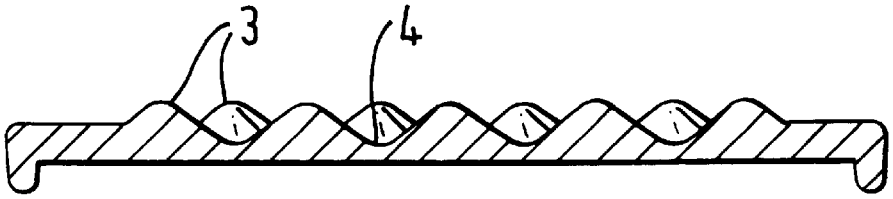
FIG. 9 is a cross-sectional view along the line E—E of FIG. 6 of the same third version of embodiment of the pad.
Figure 10:
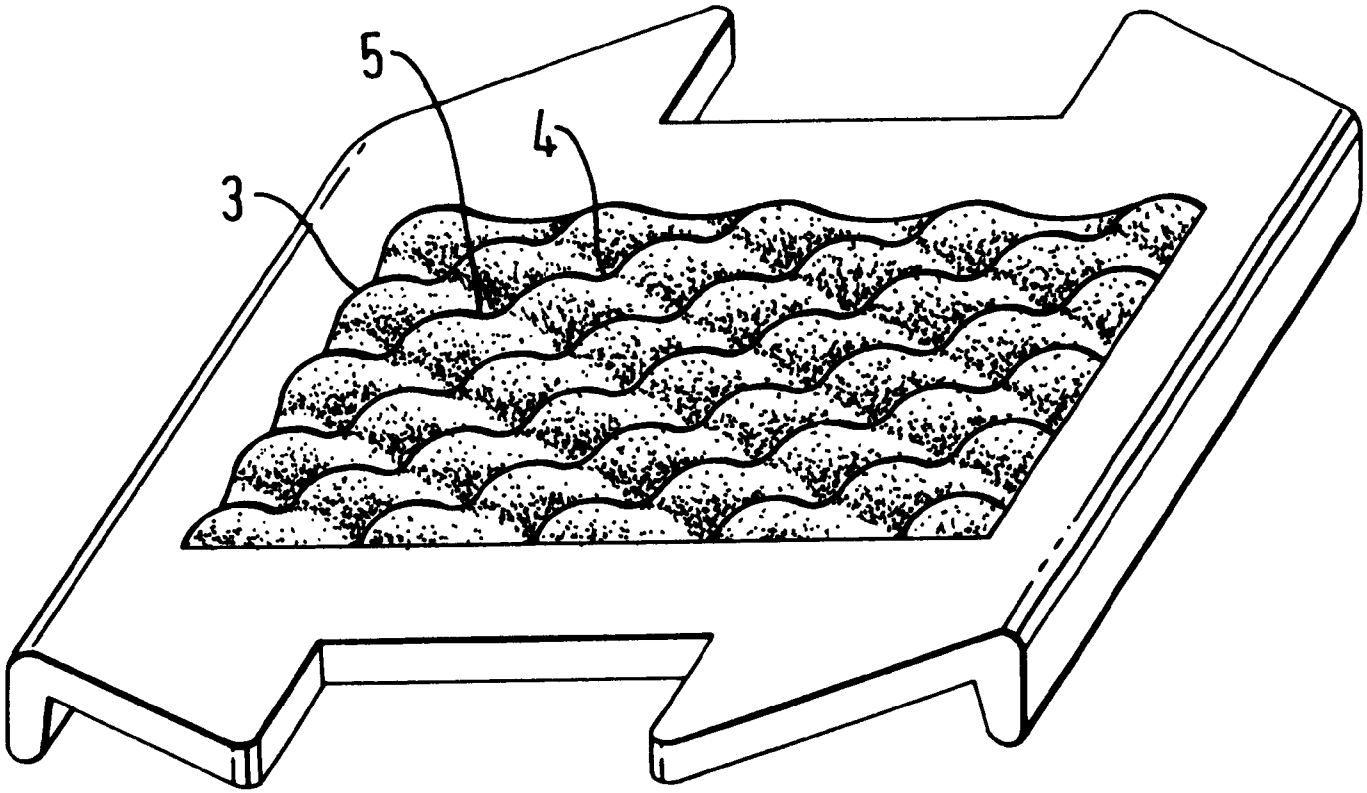
FIG. 10 is an axonometric view also of the third version of embodiment of the pad.

In the first version of embodiment of the elastic under-rail pad according to the invention, made from an elastic plastic, one of two opposite sides, the upper one designed to contact with the lower surface of a rail foot is a surface defined by a simple trigonometric sinusoidal function, the equation of which in rectangular coordinates, called also Cartesian coordinates is as follows: $z=a\cdot\sin x$; $y=b$, where a and b are numerical coefficients, the coefficient a is different from zero ($a\neq 0$), while x, y, z are coordinates of Cartesian rectangular coordinate system created in such a way that the coordinate axes x and y are parallel to the lower surface of a rail foot and the coordinate axis z is perpendicular to the same surface. On the upper side of the pad according to the invention, there are created protrusions being rolls 1 and cavities being grooves 2. The rolls 1 and grooves 2 are arranged alternately and change softly one into another creating a wavy cylindrical surface. The rolls 1 and grooves 2 run together side by side along straight parallel lines so they run at a constant distance between them. Whereas the other lower side of the elastic under-rail pad according to the invention, designed to contact with the upper surface of rail foundation, is a flat surface.

During passage of a rail vehicle the elastic under-rail pad according to the invention, distorts mildly and softly, that is why it well attenuates vibrations and absorbs impacts emerging during rolling of rail vehicle wheels of a fragment of the rail lying directly on this pad. In the initial phase of distortion the rolls 1, made on the upper side of the elastic under-rail pad according to the invention, are crushed and squeezed so that material contained in them transfers softly and freely, filling progressively the grooves 2 created on the same side of the pad. Due to a sinusoidal shape of the rolls 1 and grooves 2, during crushing of the rolls 1 by cyclic dynamic loads and vibrations emerging during passage of a rail vehicle, there is no slip between the surface of rolls 1 and the lower surface of a rail foot, what restricts advantageously wear of the elastic under-rail pad caused by grinding.

As the distortion, caused by squeezing and crushing the elastic under-rail pad according to the invention, increases, the rolls 1 are squeezed so that the grooves 2 are completely filled up. From this moment the elastic under-rail pad according to the invention becomes completely flat and that is why it is significantly more rigid and its further distortion may occur under significantly higher load increase only. This change in rigidity of the elastic under-rail pad according to the invention restricts turn of rails in a track curve under influence of lateral forces.

The second version of embodiment of the elastic under-rail pad according to the invention differ from the first version of embodiment in that the rolls 1*a* and grooves 2*a* run together side by side along curves being concentric ellipses, the major axes of which lie on one of two axes of symmetry of the elastic pad and the minor axes lie suitably on the other axis of symmetry of the pad. In the initial phase of distortion the rolls 1*a* made on the upper side of the elastic under-rail pad according to the invention, are crushed and squeezed so that material contained in them transfers softly and freely, filling progressively the grooves 2*a* created on the same side of the pad. Due to a sinusoidal shape of the rolls 1*a* and grooves 2*a*, during crushing of the rolls 1*a* there is no shift of upper surface of the elastic under-rail pad according to the invention in relation to the lower surface of a rail foot. On the account that the rolls 1*a* and grooves 2*a* run together side by side along concentric ellipses, in the initial phase of distortion the rigidity of the elastic under-rail pad according to the invention is different in different fragments of its upper surface.

There are also possible such embodiments of elastic pad according to the invention that they contain all the design features of the first or second version, excluding one. Namely the rolls and grooves in those other embodiments run together side by side partly along straight lines and partly along curves at a constant distance between them. In still different embodiments the rolls and grooves run side by side coming closer and/or going away from one another.

In the third version of embodiment of the elastic under-rail pad according to the invention, made from an elastic plastic, one of two opposite sides, the upper one designed to contact with the lower surface of a rail foot is a surface defined by a composite trigonometric sinusoidal function, the equation of which in rectangular coordinates, called also Cartesian coordinates is as follows: $z=a\cdot\sin x+b\cdot\sin y$, where a and b are numerical coefficients different from zero ($a\neq 0$, $b\neq 0$). while x, y, z are coordinates of Cartesian rectangular coordinate system created in such a way that the coordinate axes x and y are parallel to the lower surface of a rail foot and the coordinate axis z is perpendicular to the same surface. On the upper side of the elastic under-rail pad, according to the invention, there are created protrusions being cupolas 3 and cavities being bowls 4 The cupolas 3 and bowls 4 are arranged alternately. Each cupola 3 is surrounded by four adjacent bowls and four adjacent surface fragments of saddle shape 5, the four bowls 4 and four surface fragments of saddle shape 5 are arranged alternately. Also each bowl 4 is surrounded by four adjacent cupolas 3 and four adjacent surface fragments of saddle shape 5, the four cupolas 3 and four surface fragments of saddle shape 5 are arranged alternately. Whereas the other lower side of the elastic under-rail pad according to the invention, designed to contact with the upper surface of a rail foundation, is a flat surface.

During passage of a rail vehicle the elastic under-rail pad according to the invention distorts in such a way that the cupolas 3 created on the upper side of the pad are crushed and squeezed so that material contained in them transfers softly and freely filling progressively the bowls 4 created on the same side of the pad. Due to a sinusoidal shape of the cupolas 3 and bowls 4, during crushing of the cupolas 3 by cyclic dynamic loads and vibrations, emerging during passage of a rail vehicle there is no slip between the surface of cupolas 3 and the lower surface of a rail foot what restricts advantageously wear of the elastic under-rail pad caused by grinding.

As the distortion, caused by squeezing and crushing the elastic under-rail pad according to the invention, increases, the cupolas 3 are squeezed so that the bowls 4 are completely filled up. From this moment the elastic under-rail pad according to the invention becomes completely Flat and that is why it is significantly more rigid and its further distortion may occur under significantly higher load increase only. This change in rigidity of the elastic under-rail pad according to the invention restricts turn of rails in track curve under influence of lateral forces.

There are possible such embodiments of the elastic pad according to the invention that there are utilized together features of the surface defined by both simple and composite trigonometric sinusoidal and/or cosinusoidal functions on the same surface of the pad.

There are also possible such embodiments of the elastic pad according to the invention that the surfaces of both opposite sides of the pad are defined by a simple and/or composite trigonometric sinusoidal and/or cosinusoidal functions characterized by identical parameters or differing in period and/or amplitude and/or phase shift by a definite angle while it is advantageous when the sinusoidal or cosinusoidal function defining the upper side of the elastic pad according to the invention is characterized by a smaller period and a smaller amplitude than the sinusoidal or cosinusoidal function defining the lower side of the pad.

There are also possible such embodiments of the elastic pad according to the invention that surface of one side or the surfaces of both opposite sides of the pad are defined approximately by simple and/or composite trigonometric sinusoidal and/or cosinusoidal functions.

What is claimed is:

1. An elastic under rail pad made from an elastic plastic material or rubber and having two opposite sides, characterized in that at least at one of its opposite sides said pad has a surface which at least partly is defined at least approximately by a simple trigonometric sinusoidal or cosinusoidal function or by a composite trigonometric sinusoidal and cosinusoidal function, said pad thereby having at least on a part of one of said two opposite sides thereof a plurality of protrusions and cavities arranged alternately and changing softly into one another.

2. An elastic under-rail pad as claimed in claim 1, characterized in that at least on one of said opposite sides of said pad at least a part of all said protrusions are rolls and at least a part of all said cavities are grooves, said rolls and said grooves being arranged alternately forming a wavy surface.

3. An elastic under-rail pad as claimed in claim 2, characterized in that said rolls and grooves run side by side along straight or curved lines.

4. An elastic under-rail pad as claimed in claim 1, characterized in that on one of said opposite sides of said pad at least a part of all said protrusions are cupolas and at least a part of all said cavities are bowls, each said cupola is surrounded by four adjacent bowls and four adjacent surface fragments of saddle shape, with each of said four bowls and its surrounding four surface fragments of saddle shape being arranged alternately, and each bowl is surrounded by four adjacent cupolas and four adjacent surface fragments of saddle shape, with each of said four cupolas and its surrounding four surface fragments of saddle shape being arranged alternately.

* * * * *